United States Patent [19]

Mayer

[11] 3,978,584

[45] Sept. 7, 1976

[54] AMBIDEXTROUS SCISSORS

[76] Inventor: John W. Mayer, 1508 Blackhawk Drive, Schaumberg, Ill. 60172

[22] Filed: Dec. 23, 1974

[21] Appl. No.: 535,947

[52] U.S. Cl. ..... 30/256
[51] Int. Cl.[2] ..... B26B 13/00
[58] Field of Search ..... 30/256, 254, 233

[56] References Cited

UNITED STATES PATENTS

| | | | |
|---|---|---|---|
| 237,781 | 2/1881 | Starks | 30/256 |
| 300,153 | 6/1884 | Starks | 30/256 |
| 2,343,527 | 3/1944 | Boyle | 30/256 |
| 3,084,433 | 4/1963 | Kimmel | 30/254 |

FOREIGN PATENTS OR APPLICATIONS

| | | | |
|---|---|---|---|
| 75,399 | 5/1894 | Germany | 30/256 |
| 370,795 | 3/1923 | Germany | 30/256 |

*Primary Examiner*—Al Lawrence Smith
*Assistant Examiner*—Roscoe V. Parker
*Attorney, Agent, or Firm*—Coffee and Sweeney

[57] ABSTRACT

Scissors which may be used with equal ease and efficiency by either a left-handed or right-handed person. The scissors include two generally flat rigid, blade portions which are each sharpened on both edges to provide two sets of cutting edges. The blade portions are pivotally connected to one another and each includes a handle portion on one end. One of the handle portions is adapted to fit the thumb of the user while the other handle portion is larger to permit engagement of two or more fingers of the same hand in the normal fashion of scissors use. The thumb handle is pivotally mounted to its respective blade portion to permit pivotal movement from one selected position at one side of the finger handle as used during right-handed operation to a second selected position at the opposite side of the finger handle for use during left-handed operation. A detent or lock is provided to secure and hold the thumb handle in either of the selected positions.

5 Claims, 8 Drawing Figures

52
104
94
106
108
78
84
110
112

64
66
54
52
56
50
68
82
96
5
86
90
84
78
76
5
74

52
54
86
84
68
78
92
96
94
74

60
62
52
54
56
58

64
66
54
52
7
7
70
68
86
84
90
96
100
78
74

AMBIDEXTROUS SCISSORS

FIELD OF THE INVENTION

The present invention relates to an ambidextrous scissors which may be used with equal ease and efficiency with either hand.

DESCRIPTION OF THE PRIOR ART

In the past, various types of scissors were proposed to produce a universal tool which could be used equally well by both right-handed and left-handed persons, thus eliminating the need and expense of providing two very similar tools. Some of these scissors included removable handle portions which could be interchanged to permit and facilitate use by either hand. Still other types included duplicate sets of handles on the same blade portions. While the former of these type were inefficient because of the time required to interchange the handles, the latter type were very cumbersome because of the overlapping and overextending unused handles.

SUMMARY OF THE INVENTION

The present invention provides new ambidextrous scissors which can be used with equal ease in either hand. The ambidextrous scissors includes a pair of blades with both sides thereof sharpened to provide two sets of cutting edges. The blades are mounted for pivotal movement relative to each other. A handle portion is rigidly connected to one of the blade portions extending past the pivot point. A movable handle portion is pivotally connected to the other blade portion whereby the movable handle may be rotated from one side, where it is convenient for use by the right hand, through an angle of 180° to the other side, where it is convenient for use with the left hand. Locking or detent means are provided to maintain the pivotally mounted handle in the predetermined position.

DESCRIPTION OF THE PREFERRED EMBODIMENT

Figure 1:
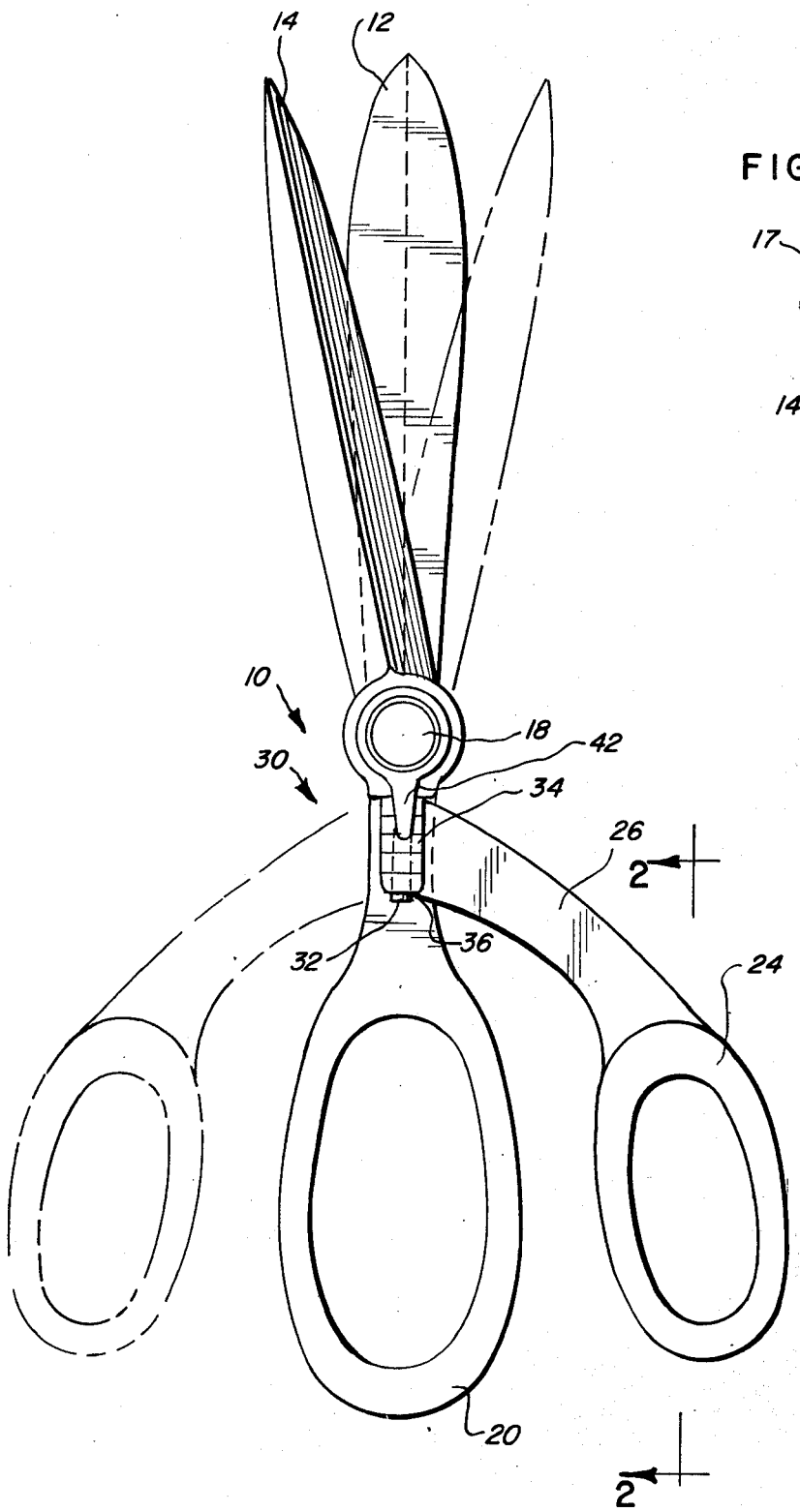
FIG. 1 is a front elevational view of the ambidextrous scissors of the present invention showing, in phantom, the second position of the movable handle.
Figure 3:
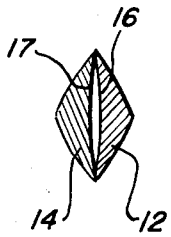
FIG. 3 is a horizontal section taken generally along the line 3—3 of FIG. 2.

The ambidextrous scissors, generally designated 10, is shown in FIG. 1 to include a pair of rigid blade portions 12 and 14. The blade portions, referring to FIG. 3, are generally triangular in cross section being tapered in both directions to provide a sharpened cutting edge on either side. The contact surfaces 16 and 17 between the blade portions 12 and 14, respectively, are generally concave to produce a self-sharpening effect on the edges during use. The blade portions also are tapered along a longitudinal axis toward the ends. The edges of the blade 12 converge generally in a point and the edges of the blade 14 converge to a generally rounded edge.

Pivotal connecting means, in the form of a pivot pin 18 is provided to mount the blade members 12 and 14 for normal pivotal scissors movement relative to one another.

Figure 2:
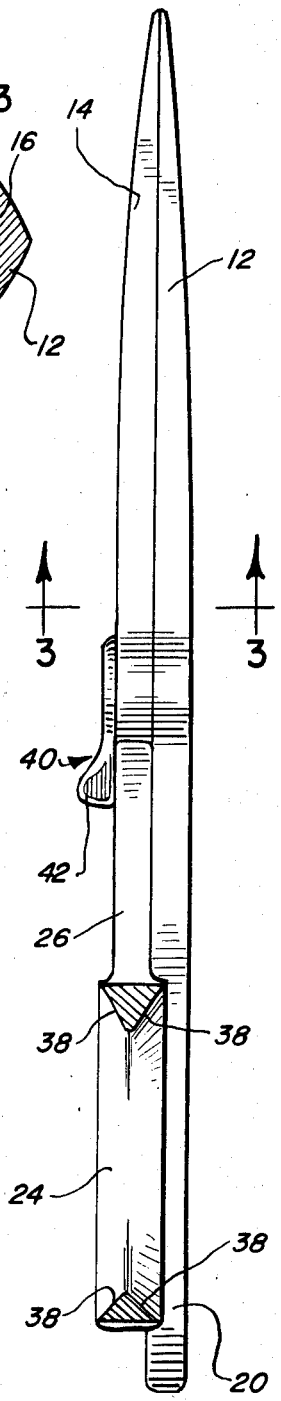
FIG. 2 is a side elevational view of the ambidextrous scissors including a section and view of one of the handles.

As best seen in FIG. 1, a finger handle portion or eye 20 is rigidly secured to the blade 12 and integral therewith. The finger handle portion is generally ovoid in shape to conveniently fit two or more fingers of either hand during use. The finger handle is positioned with the major axis in line with the longitudinal axis of the blade 12. A second, movable thumb handle or eye portion 24 is pivotally connected to the other blade 14. The handle 24 includes an arm 26 extending generally at an obtuse angle from the longitudinal axis of the blade 14. A hinge, generally designated 30, mounts the arm 26 to the blade 14. The hinge includes a pin 32 formed on the blade adjacent the pivot pin 18. The arm 26 includes a journal portion 34 on its innermost end which pivotally mounts the arm 26 on the pin 32. A snap ring 36 prevents the journal 34 from slipping off of the pin 32. This pivotal mounting of the thumb handle 24 permits the handle to be moved from the right side of the finger handle 20 as shown in FIG. 1 to the left side of the finger handle 20 as seen in phantom in FIG. 1. In the former position, the scissors 10 can be conveniently used with the right hand, while in the latter position, the scissors 10 can be conveniently used with the left hand. The handle 24, referring to FIG. 2, includes a chamfered or tapered surface 38 on each side to provide convenient surface area contact with the thumb of the user.

A locking means, generally designated 40, is provided in order to lock the movable handle 24 in either of its two positions. The locking means includes a radially directed tab 42 formed on the end of the pivot pin 18 adjacent the hinged handle arm 26. The pivot pin 18 is friction fitted within the two blade portions 12 and 14 and will remain in a preset rotational position. Therefore, when the tab 42 is directed along the axis of the blade 12, the movable arm 26 will be maintained in its preset position. When it is desired to rotate the handle 24 to its other position, the tab 42 is merely rotated approximately 90° to permit pivotal movement of the arm 24 through an angle of 180° whereafter the tab is realigned along the axis of the blade 12 to maintain the handle 24 in the desired position.

In some of the previous scissors which have been proposed for universal use, it was necessary to rotate one of the blade portions approximately 360° about the pivot pin to change the scissors from the right hand operable position to the left hand operable position or vice versa. In such scissors it was impossible to provide a stop surface for the blades after complete engagement since they required complete rotational freedom. In the embodiment of the present invention, since the handle 24 rotates to permit left hand or right hand use, stop means can be provided to limit the travel of the blade after complete engagement. This stop means is provided by the dimensions of the handles themselves. More particularly, referring to the bottom of FIG. 2, the cross-section or thickness of the thumb handle 24 is slightly larger than that of the arm 26 so that a portion thereof will engage the finger handle 20. The finger handle 20 is seen to be overlapped by a portion of the thumb handle 24 which is considerably wider than the finger handle 20. When the thumb handle 24 is moved to the second position, as shown in phantom in FIG. 1, again a portion of the thicker handle 24 will engage the opposite side of the finger handle 20 and again provide a stop means as the blades complete full engagement. In this manner, since it is not necessary for complete circular rotation between the blades, a stop means is conveniently provided to limit the travel of the blades 14 and 12 after total engagement.

Figures 4, 5, 6, 7, 8:
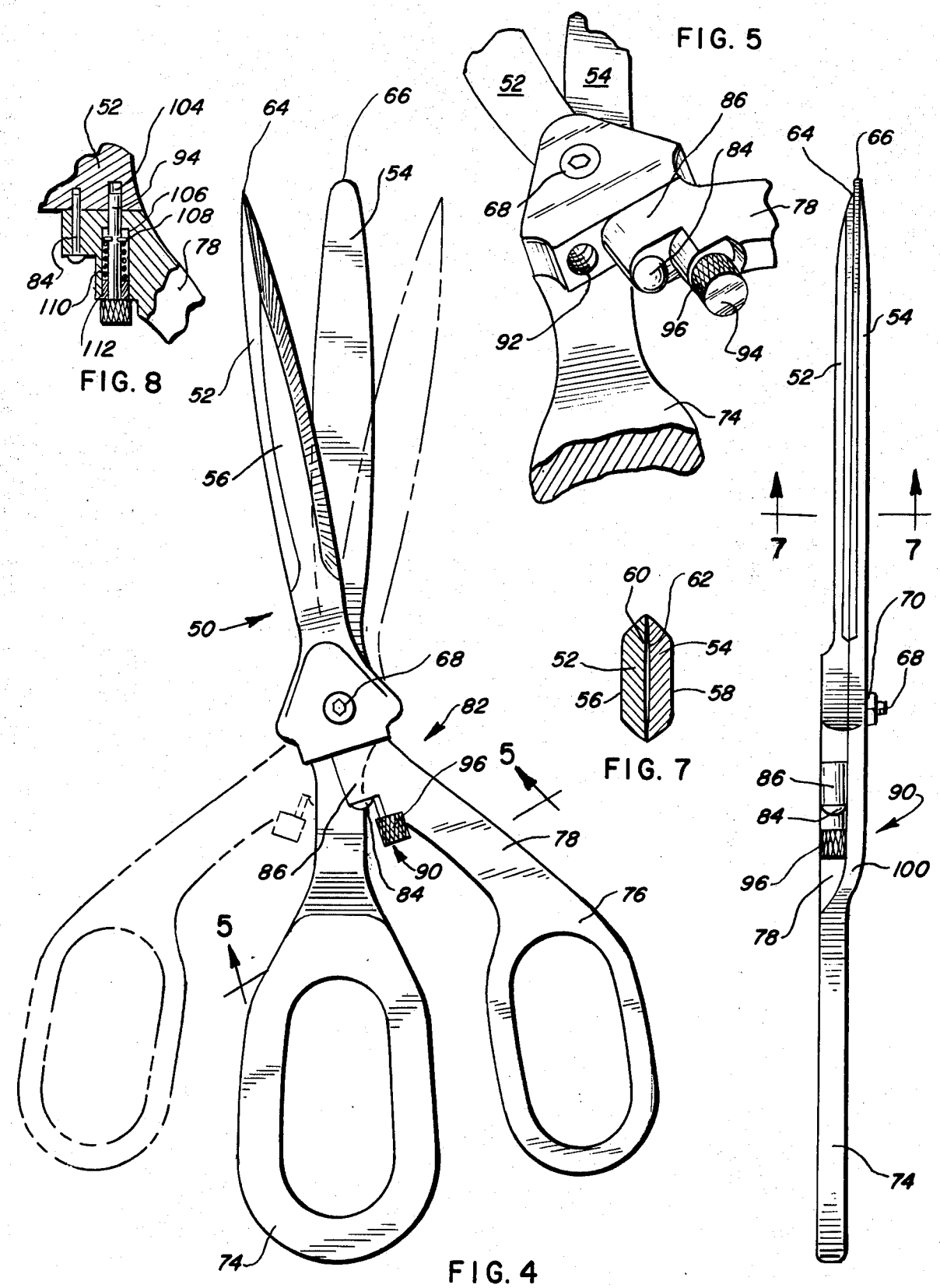
FIG. 4 is a front elevational view of an alternate embodiment of the ambidextrous scissors, showing in phantom, the second position of the movable handle.
FIG. 5 is a fragmented perspective view of the handle locking means, taken generally along the line 5—5 of FIG. 4.
FIG. 6 is a side elevational view of the ambidextrous scissors shown in FIG. 4.
FIG. 7 is a section view of the blades taken generally along the line 7—7 of FIG. 6.
FIG. 8 is a section showing yet another embodiment of the handle locking means useful in the present invention.

An alternate embodiment of the ambidextrous scissors is seen in FIG. 4, generally designated 50. The scissors 50 also includes a pair of rigid blade portions 52 and 54. Each blade portion, referring to FIG. 7, includes a flat outer surface 56 and 58 respectively. The opposite sides of each blade portion are tapered to provide a sharpened cutting edge on either side. The contact surfaces 60 and 62, between the blades, are slightly concave to provide a continued sharpening effect on the outer edges as the scissors is used. The tip or end of the blade portion 52 is sharpened to a point 64 which enables the user to pierce through the material to be cut. The other blade 54 includes a rounded end portion 66 to prevent accidental injury to the user. In the closed position, as seen in FIG. 6, the pointed end 64 is seen to be slightly shorter than the curved or dull blunt end 66 so as to avoid injury when the scissors are not in use for cutting purposes.

Similar to the prior embodiment, pivotal connecting means, in the form of a bolt 68 and nut 70 are provided to mount the blade members 52 and 54 for pivotal movement relative to each other.

A finger handle or eye 74 is rigidly secured to the blade 54. The finger handle portion 74 is generally ovoid in shape to correctly fit the fingers of either hand during use. The finger handle 74 is positioned with the major axis of the ovoid generally in line with the longitudinal axis of the blade 54. A second, movable thumb handle or eye portion 76 is pivotally connected to the pointed blade 52. The handle 76 includes an arm 78 extending generally at an obtuse angle from the longitudinal axis of the blade 52. A hinge, generally designated 82, mounts the arm 78 to the blade 52. More particularly, the hinge 82 includes a pin 84 on the blade 52 adjacent the pivot along the longitudinal axis of the blade 52. The arm 78 includes a journal portion 86 on its innermost end which pivotally mounts the arm 78 on the pin 84. The pin 84 includes an enlarged head to prevent the journal 86 from slipping off of the pin. This pivotal mounting of the thumb handle 76 permits the handle to be moved from the right side of the finger handle 74, as shown in FIG. 4 to the left side of the finger handle as shown in phantom in FIG. 4. In the former position, the scissors 50 can be used conveniently with the right hand, while in the latter position, the scissors can be used conveniently with the left hand. Again, the cross section of the thumb handle 76 includes generally inwardly tapered surfaces on both sides to permit convenient engagement with the surfaces of the thumb.

Locking means, generally designated 90, is provided to lock the movable handle 76 in either of its two positions. The locking means, referring to FIG. 5, includes a pair of threaded bores 92 in the blade portion 52. A longitudinal bore, parallel to the axis of the pivot pin 84, is provided to enable a threaded plunger 94 to be inserted therethrough into one of the bores 92. The longitudinal bore may be threaded or slightly larger than the outside thread diameter of the plunger 94. The plunger includes a knurled portion 96 so that the plunger 94 may be threaded into one of the bores 92 to lock the movable handle 76 in position. When it is desired to move the movable handle 76 from one side of the finger handle 74 to the other, the plunger 94 is merely removed to permit rotation of the handle and then reinserted into the other threaded bore 92.

In the alternate embodiment shown, a stop means is provided to limit the travel of the blades after complete engagement. The finger handle 74, referring to FIG. 6, includes a curved offset portion 100 so that the finger handle 74 and the movable thumb handle 76 lie in the same plane. Therefore, with the scissors in use, the handle portions will engage and prevent continued rotation of the blades after complete engagement without requiring the necessity of a tab, pin, or other protrusion on one or the other of the blade portions 52 and 54.

FIG. 8 shows a third embodiment for the locking means. Like numerals in FIG. 8 refer to the same components of the previously discussed locking means. In this embodiment, the plunger 94 is spring biased into a bore 104 provided in either side of the pivot pin 84. The plunger 94 is fitted within an enlarged bore 106 in the arm 78. The plunger includes a C-washer 108 which engages a small coil spring 110 also fitted within the bore 106. A threaded sleeve 112 maintains the spring 110 within the bore 106 so that the spring constantly biases the plunger 94 into one of the bores 104. When it is desired to move the thumb handle from one side to the other, the plunger 94 is merely retracted against the biasing force of the spring 110. The handle can then be rotated to the other position whereafter the plunger is released for engagement with the bore 104 to lock the handle 76 in the desired position.

Thus, as shown and described, the scissors of the present invention can be effectively and efficiently used with equal ease by either hand after a simple realignment of the thumb handle relative to the finger handle.

The foregoing detailed description has been given for clearness of understanding only and no unnecessary limitations should be understood therefrom as some modifications will be obvious to those skilled in the art.

I claim:

1. A pair of ambidextrous scissors, comprising:

a first rigid member;

a second rigid member, said first and second rigid members each having a blade portion with opposite edges thereof sharpened to provide two sets of cutting edges, the blade portion of said first member having a blunt blade end and extending past the end of said second member;

a base portion secured to the opposite end of said second member and pivotal means mounting said base to said first rigid member to permit relative pivotal movement between the blade portions of the rigid members;

a finger handle portion on said first rigid member having an eye sized to accommodate at least two fingers of the user;

a movable handle portion having a smaller eye for accommodating the thumb of the user;

hinge means mounting said movable handle portion to said base for pivotal movement about the longitudinal axis of said second member between a first position for use by one hand of the user and a second position for use by the other hand of the user, said hinge means preventing longitudinal movement of said movable handle with respect to said second member;

selectively operable locking means for maintaining the movable handle in either its first or second position, said selectively operable locking means including a plunger mounted in said movable handle portion for alignment with a pair of bores in said base, said bores being spaced from said hinge means by a distance equivalent to the diameter of the bore and on opposite sides of said hinge means so that the plunger will engage one or the other of said bores when in its respective positions; and a chamfered edge on both sides of the eye of said finger handle and the eye of said movable handle to facilitate the use of the scissors with one hand when in the first position and with the other hand when in the second position.

2. The ambidextrous scissors of claim 1 wherein said plunger includes a biasing spring to constantly urge the plunger in a generally longitudinal direction into one of said locking bores.

3. The ambidextrous scissors of claim 1 wherein said plunger is threaded and each of said bores includes an internal thread to permit selective threading of the plunger into either of said threaded bores to maintain the movable handle in its first or second position.

4. A pair of ambidextrous scissors, comprising:

a first rigid member a second rigid member, said first and second rigid members each having a blade portion with opposite edges thereof sharpened to provide two sets of cutting edges, the blade portion of said first member having a blunt blade end and extending past the end of said second member;

a base portion secured to the opposite end of said second member and pivotal means mounting said base to said first rigid member to permit relative pivotal movement between the blade portions of the rigid members;

a finger handle portion on said first rigid member having an eye sized to accommodate at least two fingers of the user;

a movable handle portion having a smaller eye for accommodating the thumb of the user;

hinge means mounting said movable handle portion to said base for pivotal movement about the longitudinal axis of said second member between a first position for use by one hand of the user and a second position for use by the other hand of the user, said hinge means preventing longitudinal movement of said movable handle with respect to said second member;

selectively operable locking means for maintaining the movable handle in said first or second position, said locking means including a locking tab mounted co-axially with the pivotal mounting means so as to be rotatable with respect to said base to selectively engage the outer surface of said movable handle and prohibit rotation of the movable handle relative to said second member when in engagement therewith; and a chamfered edge on both sides of the eye of said finger handle and the eye of said movable handle to facilitate the use of the scissors with one hand when in the first position and with the other hand when in the second position.

5. The ambidextrous scissors of claim 4 wherein said tab includes means defining a friction surface substantially in engagement with said base so that said tab rotates with said base to maintain the movable handle in either its first or second position when in engagement with said locking tab.

* * * * *